US007853164B2

(12) United States Patent
Sanada et al.

(10) Patent No.: US 7,853,164 B2
(45) Date of Patent: Dec. 14, 2010

(54) IMAGE FORMING APPARATUS AND POWER CONTROL METHOD

(75) Inventors: Keiichi Sanada, Kanagawa (JP); Takeshi Sano, Kanagawa (JP); Yoshihisa Ashikawa, Kanagawa (JP); Naoki Sato, Kanagawa (JP); Tomonori Maekawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 594 days.

(21) Appl. No.: 11/898,127

(22) Filed: Sep. 10, 2007

(65) Prior Publication Data

US 2008/0069584 A1 Mar. 20, 2008

(30) Foreign Application Priority Data

Sep. 15, 2006 (JP) ..... 2006-250380
Jul. 26, 2007 (JP) ..... 2007-194707

(51) Int. Cl.
*G03G 15/20* (2006.01)

(52) U.S. Cl. ..... 399/69; 399/88

(58) Field of Classification Search ..... 399/69, 399/88

See application file for complete search history.

(56) References Cited

U.S. PATENT DOCUMENTS

2003/0178410 A1* 9/2003 Satoh ..... 219/494
2006/0051118 A1* 3/2006 Kaji et al. ..... 399/69

FOREIGN PATENT DOCUMENTS

JP 2003-244359 8/2003
JP 2003-323085 11/2003
JP 2003323085 A * 11/2003

* cited by examiner

*Primary Examiner*—David M Gray
*Assistant Examiner*—Andrew V Do
(74) *Attorney, Agent, or Firm*—Harness, Dickey & Pierce, P.L.C.

(57) ABSTRACT

A plurality of heating units generates a heat by an alternating-current power supplied from a corresponding alternating-current power supply unit through a corresponding input terminal and supplying the heat to a fixing unit that fixes a toner image transformed on a recording paper by heating. A plurality of power control units controls the alternating-current power to a corresponding heating unit. A plurality of detecting units detects a reference phase of waveform of the alternating-current power. A control unit individually controls the power control units based on detected signals output from the detecting units.

15 Claims, 13 Drawing Sheets

FIG. 12

| TYPE | HT1 | HT2 | | HT3 |
|---|---|---|---|---|
| | | HT21 | HT22 | |
| 60-SPM MODEL (JAPAN) | – | 600 W/97 V | 600 W/97 V | 270 W/97 V |
| 75-SPM MODEL (JAPAN) | 250 W/97 V | 700 W/97 V | 700 W/97 V | 400 W/97 V |
| 60-SPM MODEL (USA) | 250 W/117 V | 700 W/117 V | 700 W/117 V | 400 W/117 V |
| 75-SPM MODEL (USA) | 400 W/227 V | 700 W/227 V | 700 W/227 V | 600 W/227 V |
| 60-SPM MODEL (EUROPE) | 250 W/117 V | 700 W/117 V | 700 W/117 V | 400 W/117 V |
| 75-SPM MODEL (EUROPE) | 400 W/227 V | 700 W/227 V | 700 W/227 V | 600 W/227 V |

IMAGE FORMING APPARATUS AND POWER CONTROL METHOD

CROSS-REFERENCE TO RELATED APPLICATIONS

The present application claims priority to and incorporates by reference the entire contents of Japanese priority documents, 2006-250380 filed in Japan on Sep. 15, 2006 and 2007-194707 filed in Japan on Jul. 26, 2007.

BACKGROUND OF THE INVENTION

1. Field of the Invention

The present invention relates to an image forming apparatus and a power control method.

2. Description of the Related Art

A typical image forming apparatus, such as a printer, a copier, and a facsimile, includes a fixing unit. The fixing unit melts a toner image formed on a recording medium (such as a paper and an OHP transparency) by heat generated by a heating unit, and applies a pressure to the recording medium, to fix the toner image on the recording medium. The heating unit includes a halogen heater made by placing tungsten filaments in a glass tube filled with inert gas.

Heating of the halogen heater is controlled by changing the time during which power is supplied from a commercial power supply unit with a power control element such as a triac. A general power control method includes a phase control method and an on/off control method. In the phase control method, a triac is turned on after a predetermined time from a zero-cross point of an alternating current (AC) voltage applied from a commercial power supply unit, and thereafter, the power is turned off at the timing when the polarity of the AC power voltage applied to a heating unit is reversed due to the characteristics of the triac, thereby controlling the time from the zero-cross point to the turning-on of the triac. In the on/off control method, a power control element is turned on/off every half cycle or more of a frequency of a commercial power supply unit.

In a soft start and a soft stop, a phase angle is gradually changed when starting/stopping supplying power to a halogen heater. The soft start and the soft stop prevent a large current from flowing into the halogen heater at the instant of turning on/off the halogen heater by gradually increasing/decreasing the on-duty ratio at the time of starting/stopping supplying power to the halogen heater. Accordingly, influence on other devices due to a harmonic current and a power voltage variation is suppressed. In both of the phase control method and the on/off control method, the halogen heater is controlled based on a zero-cross timing of the frequency of the power supply unit.

An image forming apparatus having a high throughput often employs a fixing roller with large heat capacity at a heating unit so that a temperature drop of the fixing roller is prevented at the time of image formation. However, because such fixing roller needs about a few minutes to reach a predetermined temperature to be ready for use, a waiting time for outputting a printed sheet is relatively long. When a fixing roller with smaller heat capacity is used to shorten the temperature rising time of the fixing roller, a temperature drop of the fixing roller may occur at the time of image formation.

Using a power source of 200 V can increase power capacity of a heating unit, such as a halogen heater, or a power supplied to the fixing roller, so that the temperature rising time of the fixing roller can be shortened. However, in some countries or regions, a typical commercial power supply unit in common offices is 100 V×15 A, and a 200 V power supply is available only with a special installation. Thus, expecting a voltage higher than 100 V is not realistic.

Japanese Patent Application Laid-open Nos. 2003-244359 and 2003-323085 disclose technologies in which a plurality of power cords are provided, and the power is supplied from a plurality of commercial power supply units through the power cords, thereby supplying the power over 100 V×15 A to a load.

However, in the above technologies, because both reference phases (zero-cross points) and frequencies of AC powers supplied through the power cords need to be the same, if the reference phases or the frequencies of the supplied AC powers are not the same, the power control methods in the above technologies cannot be performed properly. For example, when the power is supplied through two power cords, if the frequencies of the AC powers supplied through the power cords are 50 Hz and 60 Hz, respectively, or if one of the AC power supply units is a commercial power supply unit while the other one is a different type of power supply unit, such as a private power generator having a different frequency, the zero-cross timings become different from each other. Therefore, because the phase of either one of the AC power supply units cannot be controlled properly, a harmonic current or a power voltage variation may occur due to the interference of both frequencies, which may result in disadvantageously affecting other devices.

SUMMARY OF THE INVENTION

It is an object of the present invention to at least partially solve the problems in the conventional technology.

An image forming apparatus according to one aspect of the present invention includes a fixing unit that fixes a toner image transformed on a recording paper by heating; a plurality of input terminals each being connected to a corresponding alternating-current power supply unit from among a plurality of alternating-current power supply units; a plurality of heating units each generating a heat by an alternating-current power supplied from a corresponding alternating-current power supply unit through a corresponding input terminal and supplying the heat to the fixing unit; a plurality of power control units each controlling the alternating-current power to a corresponding heating unit; a plurality of detecting units each detecting a reference phase of waveform of the alternating-current power supplied from a corresponding alternating-current power supply unit to a corresponding heating unit through a corresponding input terminal; and a control unit that individually controls the power control units based on detected signals output from the detecting units.

A method of controlling a power according to another aspect of the present invention includes inputting an alternating-current power from each of a plurality of alternating-current power supply units to each of a plurality of input terminals; controlling an application of the alternating-current power supplied from each of the alternating-current power supply units to each of a plurality of heating units through each of the input terminals by each of a plurality of power control units; detecting a reference phase of waveform of the alternating-current power by each of a plurality of detecting units from the alternating-current power supplied from each of the alternating-current power supply units through each of the input terminals; and controlling the power control units individually based on detected signals output from the detecting units.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12 is a table representing power consumptions and rated voltages of heaters.

DETAILED DESCRIPTION OF THE PREFERRED EMBODIMENTS

Exemplary embodiments of the present invention are explained in detail below with reference to the accompanying drawings.

Figure 1:
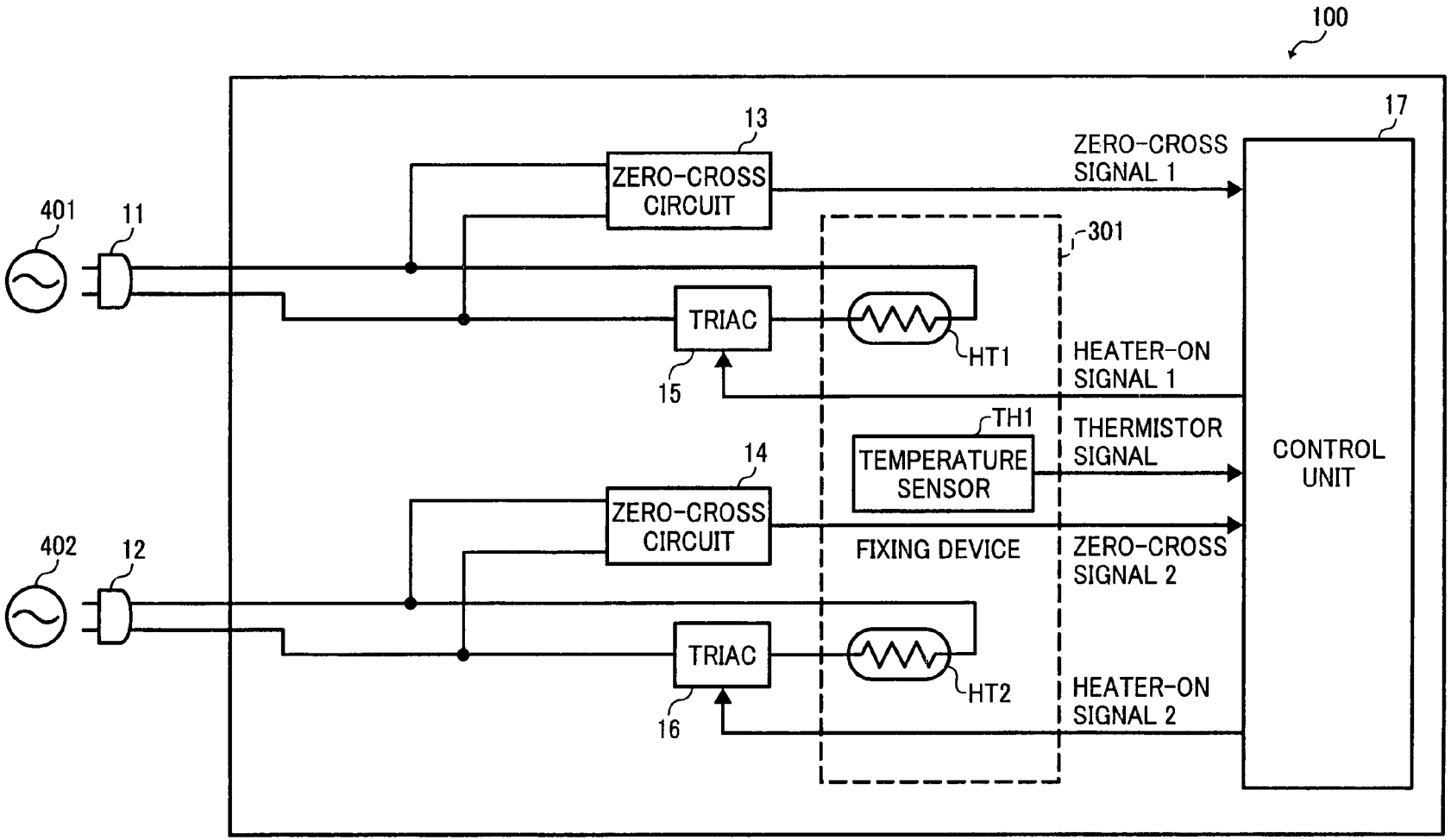
FIG. 1 is a block diagram of a heating control system according to a first embodiment of the present invention.
Figure 5:
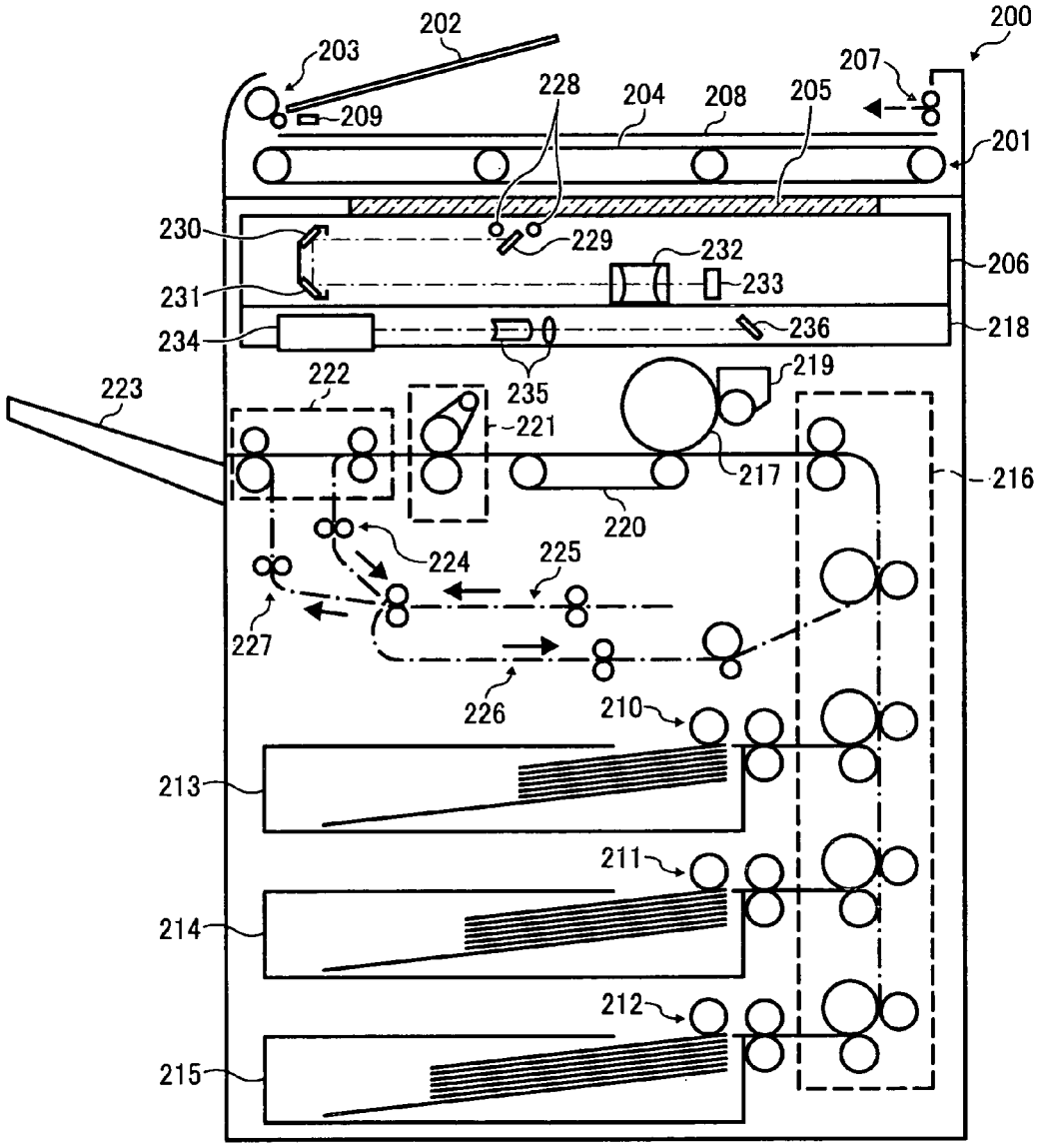
FIG. 5 is a schematic diagram of an image forming apparatus.

FIG. 1 is a block diagram of a control system 100 that controls a heater HT1 and a heater HT2 of a fixing unit 221 in an image forming apparatus 200 shown in FIG. 5 according to a first embodiment of the present invention. The control system 100 includes power cords 11 and 12 as input terminals, zero-cross circuits 13 and 14 as detecting units, triacs 15 and 16 as power control units, the heaters HT1 and HT2 as heating units, a temperature sensor TH1, and a control unit 17.

The AC power to the heater HT1 is supplied from an external AC power supply unit 401 through the power cord 11. The AC power to the heater HT2 is supplied from an external AC power supply unit 402 through the power cord 12.

Each of the AC power supply units 401 and 402 is an independent AC power supply unit. For example, the AC power supply unit 401 can be a 50-Hz commercial power supply unit, and the AC power supply unit 402 can be a 60-Hz commercial power supply unit, or vice versa. Furthermore, for example, one of the AC power supply units can be a commercial power supply unit, and the other can be a different power supply, such as a private power generator, having a frequency different from that of the commercial power supply unit.

The zero-cross circuit 13 detects a reference phase (zero-cross points) of the AC power supplied from the AC power supply unit 401 through the power cord 11, and outputs a detected signal to the control unit 17 as a zero-cross detection signal (zero-cross signal 1). The zero-cross circuit 14 detects a reference phase (zero-cross points) of the AC power supplied from the AC power supply unit 402 through the power cord 12, and outputs a detected signal to the control unit 17 as a zero-cross detection signal (zero-cross signal 2).

Figure 2:
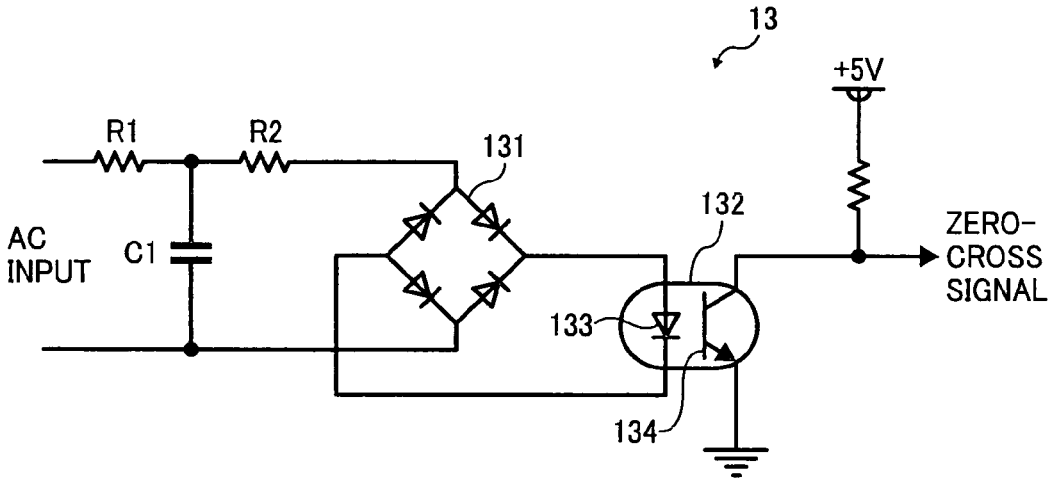
FIG. 2 is a circuit diagram of one example of a zero-cross circuit.

FIG. 2 is a circuit diagram of an example of the zero-cross circuit 13. FIG. 2 is for explaining the zero-cross circuit 13; however, the zero-cross circuit 14 has the same configuration as that of the zero-cross circuit 13.

An input voltage, which is input from the AC power supply unit 401 to the zero-cross circuit 13, is filtered by a resistor R1, a resistor R2, and a capacitor C1, to remove noise. Thereafter, the input voltage is full-wave rectified in a diode bridge 131, and is applied to a light emitting diode (LED) 133 of a photocoupler 132.

When the input voltage is around 0 V, i.e., at the zero-cross timing, because a low voltage is applied to the LED 133, the light amount of the LED 133 becomes zero or extremely small. Then, a photo transistor 134 of the photocoupler 132 is turned off, and the zero-cross signal (collector current), which is output from a collector of the photo transistor 134, becomes high (H).

When the input voltage is not at the zero-cross timing, because a high voltage is applied to the LED 133, the light amount of the LED 133 becomes large. Then, the photo transistor 134 of the photocoupler 132 is turned on, and the zero-cross signal (collector current), which is output from the collector of the photo transistor 134, becomes low (L).

Figure 3:
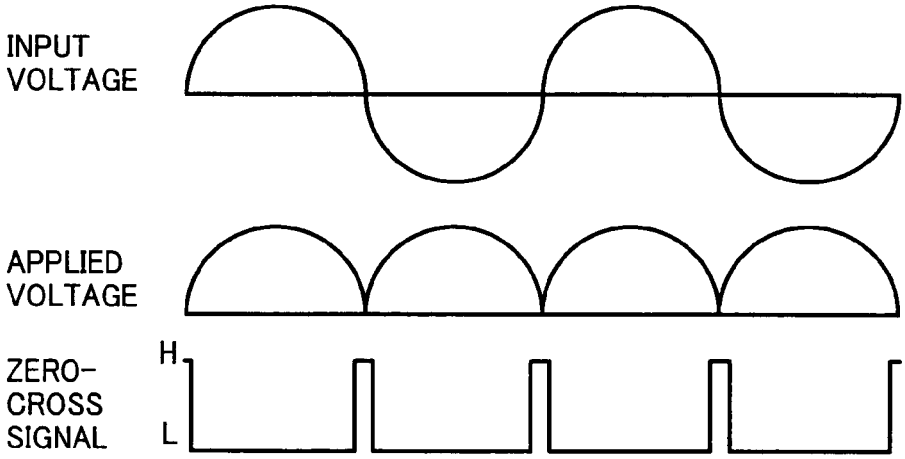
FIG. 3 is a timing chart representing the relationship among an input voltage from an AC power source, a voltage applied to a photodiode in a photocoupler, and a zero-cross signal.

FIG. 3 is a timing chart representing the relationship among the input voltage (AC input voltage) input from the AC power supply unit 401, the applied voltage applied to the LED 133, and the zero-cross signal. The zero-cross signal shown in FIG. 3 is generated and is output to the control unit 17.

As shown in FIG. 1, the triac 15 is connected between the power cord 11 and the heater HT1. The triac 15 is turned on by a heater-on signal 1 output from the control unit 17, and allows the AC power supplied from the AC power supply unit 401 through the power cord 11 to be supplied to the heater HT1. When the polarity of the input voltage applied to the triac 15 is reversed, the triac 15 becomes off-state due to its own electrical properties, so that the AC power is stopped being supplied to the heater HT1. The triac 16 is connected between the power cord 12 and the heater HT2. The triac 16 is turned on by a heater-on signal 2 output from the control unit 17, and allows the AC power supplied from the AC power supply unit 402 through the power cord 12 to be supplied to the heater HT2. When the polarity of the input voltage applied to the triac 16 is reversed, the triac 16 becomes off-state due to its own electrical properties, so that the AC power is stopped being supplied to the heater HT2.

Because relatively cheap triacs are used as the power control units, an image forming apparatus becomes cheap.

The heaters HT1 and HT2 are, for example, halogen heaters that generate heat by power supply. The heaters HT1 and HT2 are controlled by the triacs 15 and 16, respectively. The heater HT1 that is turned on is supplied with the AC power from the AC power supply unit 401 through the power cord 11. The heater HT2 that is turned on is supplied with the AC power from the AC power supply unit 402 through the power cord 12.

The heaters HT1 and HT2 are arranged inside a fixing roller 301 and generate heat, so that the fixing roller 301 is heated. The power consumption and the rated voltage of each of the heaters HT1 and HT2 are not specifically limited. In the embodiment, both heaters HT1 and HT2 have almost the same specification.

The temperature sensor TH1 is a thermistor or a temperature detecting element arranged near the surface of the fixing roller 301. The temperature sensor TH1 detects the surface temperature of the fixing roller 301 and outputs a detection signal (thermistor signal) to the control unit 17.

The control unit 17 includes a microcomputer having a Central-Processing Unit (CPU), a Read Only Memory (RAM), and a Random Access Memory (RAM). The CPU, the RAM, and the ROM are not shown in the drawings. The CPU is connected to the ROM that stores therein computer programs and data for controlling the image forming apparatus (fixing unit), and controls a printer engine that performs image formation, and a power supply circuit based on the computer programs stored in the ROM. Furthermore, the CPU stores various information related to the control operations in the RAM.

Specifically, the control unit 17 controls the heater HT1 and the heater HT2 separately by outputting the heater-on signal 1 and the heater-on signal 2 to the respective triacs 15 and 16 based on the temperature detected by the temperature sensor TH1.

The power control for each triac is performed based on the information (hereinafter, "temperature table") stored in the ROM. In the temperature table, a difference between a predetermined temperature and a temperature of the fixing roller 301 is related to an output timing of each heater-on signal set according to the difference. The output timing indicates the time (phase angle) from the zero-cross timing of the zero-cross signal (zero-cross signal is on (H)), which is input from each of the zero-cross circuits 13 and 14, to the time of outputting the heater-on signal, under a predetermined frequency (e.g., 50 Hz). The output timing is a parameter related to the phase control of each triac.

Every time the temperature of the fixing roller 301 is detected by the temperature sensor TH1, the control unit 17 reads out the output timing (phase angle) of each heater-on signal, which corresponds to the difference between the temperature of the fixing roller 301 and the predetermined temperature, from the ROM, and outputs the heater-on signal 1 and the heater-on signal 2 to the triacs 15 and 16 with the phase angles, respectively.

According to the embodiment, the output timing of the heater-on signal to be output to each triac is obtained from the temperature table stored in the ROM. Alternatively, the output timing of each heater-on signal can be obtained by using a predetermined relational expression capable of leading the output timing of each heater-on signal based on the difference between the temperature of the fixing roller 301 and the predetermined temperature.

Figure 4:
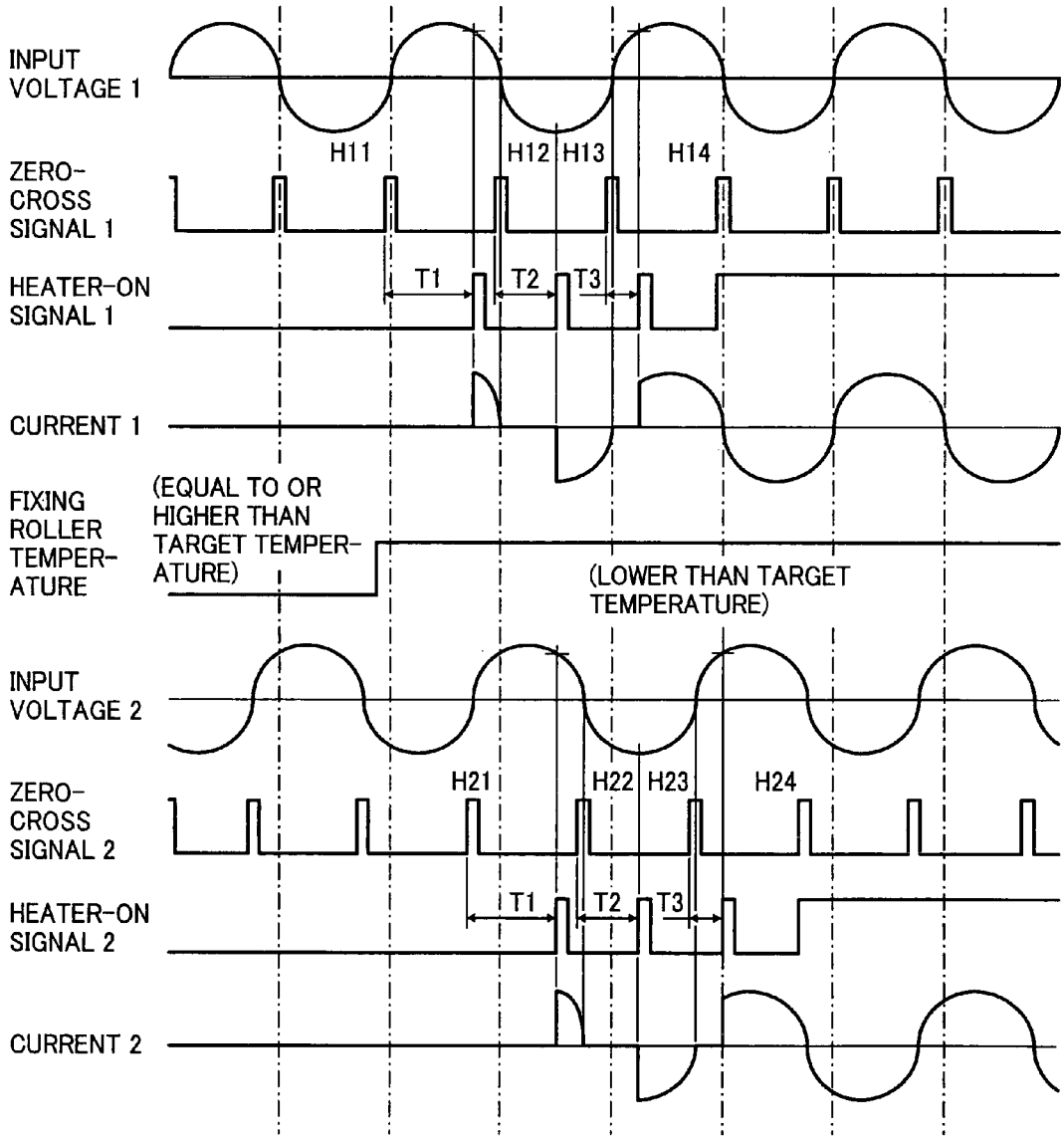
FIG. 4 is a timing chart for explaining a power control.

FIG. 4 is a timing chart for explaining power control by the control system 100 (the control unit 17), and represents the case where the phase angle of each triac is increased in steps of 45 degrees (soft start). The soft start prevents a large current from flowing at the instant of turning on the heater, thereby suppressing influence on other devices due to a harmonic current and a power voltage variation.

In FIG. 4, the waveforms of an "input voltage 1" and an "input voltage 2" represent the voltage waveforms of the AC powers supplied from the AC power supply unit 401 and the AC power supply unit 402, respectively, and the waveforms of a "zero-cross signal 1" and a "zero-cross signal 2" represent the zero-cross signals that are output from the zero-cross circuit 13 and the zero-cross circuit 14, respectively.

Furthermore, the waveforms of a "heater-on signal 1" and a "heater-on signal 2" represent the heater-on signals that are output from the control unit 17 to the triac 15 and the triac 16, respectively, and the waveforms of a "current 1" and a "current 2" represent the currents that flow into the heater HT1 and the heater HT2, respectively. Furthermore, the waveform of a "fixing roller temperature" represents the temperature detected by the temperature sensor TH1.

Because the waveforms of the AC powers supplied from the respective AC power supply unit 401 and the AC power supply unit 402 are different in phase, the zero-cross timings detected by the zero-cross circuits 13 and 14 are not synchronized with each other. Therefore, the zero-cross timings are individually detected.

As a result of the comparison between the temperature detected by the temperature sensor TH1 and a predetermined target temperature Tt, if the control unit 17 judges that the temperature of the fixing roller 301 is lower than the target temperature Tt, the control unit 17 outputs the heater-on signal 1 and the heater-on signal 2 to the triacs 15 and 16 with predetermined phases, respectively, based on the temperature table stored in the ROM. Whereby, the control unit 17 controls the heater HT1 and the heater HT2 individually.

A first pulse of the heater-on signal 1 is output to the triac 15 after a time T1 passes from the output of a zero-cross timing pulse H11. The zero-cross timing pulse H11 is the first timing pulse output after the control unit 17 detects that the temperature of the fixing roller 301 becomes lower than the target temperature Tt. Once the triac 15 becomes on-state, the triac 15 keeps the on-state until the next zero-cross timing pulse H12 at which the polarity of the input voltage 1 is reversed due to its electrical properties. Therefore, the heater HT1 is on for the time period obtained by subtracting the time T1 from a half cycle in the waveform of the input voltage 1.

When a time T2 passes from the output of the zero-cross timing pulse H12, a second pulse of the heater-on signal 1 is output to the triac 15 from the control unit 17, and the triac 15 keeps the on-state until the next zero-cross timing pulse H13. Therefore, the heater HT1 is on for the time period obtained by subtracting the time T2 from a half cycle in the waveform of the input voltage 1. When a time T3 passes from the output of the zero-cross timing pulse H13, a third pulse of the heater-on signal 1 is output to the triac 15 from the control unit 17, and the triac 15 keeps the on-state until the next zero-cross timing pulse H14. Therefore, the heater HT1 is on for the time period obtained by subtracting the time T3 from a half cycle in the waveform of the input voltage 1.

A first pulse of the heater-on signal 2 is output to the triac 16 after the time T1 passes from the output of a zero-cross timing pulse H21. The zero-cross timing pulse H21 is the first timing pulse output after the control unit 17 detects that the temperature of the fixing roller 301 becomes lower than the target temperature Tt. Once the triac 16 becomes on-state, the triac 16 keeps the on-state until the next zero-cross timing pulse H22 at which the polarity of the input voltage 2 is reversed due to its electrical properties, in the same manner as the triac 15. Therefore, the heater HT2 is on for the time period obtained by subtracting the time T1 from a half cycle in the waveform of the input voltage 2.

When the time T2 passes from the output of the zero-cross timing pulse H22, a second pulse of the heater-on signal 2 is output to the triac 16 from the control unit 17, and the triac 16 keeps the on-state until the next zero-cross timing pulse H23. Therefore, the heater HT2 is on for the time period obtained by subtracting the time T2 from a half cycle in the waveform of the input voltage 2. When the time T3 passes from the output of the zero-cross timing pulse H23, a third pulse of the heater-on signal 2 is output to the triac 16 from the control unit 17, and the triac 16 keeps the on-state until the next zero-cross timing pulse H24. Therefore, the heater HT2 is on for the time period obtained by subtracting the time T3 from a half cycle in the waveform of the input voltage 2.

According to the embodiment, the reference phase (zero-cross points) is detected for each AC power supply unit, and the powers supplied from the AC power supply units to the heaters are controlled by the triacs 15 and 16 based on the reference phases, respectively. Thus, even if the reference phases of the powers supplied from the respective power supply units are different from each other, the power supplied to each heater can be appropriately controlled, enabling to suppress a harmonic current and a power voltage variation to be generated.

Because the triac 15 and the triac 16 are individually controlled based on the difference between the temperature detected by the temperature sensor TH1 and the predetermined temperature, the temperature of each of the heaters HT1 and HT2 can be maintained to be a desired temperature.

According to the embodiment, two power cords are provided, however, the number of the power cords can be changed as long as the zero-cross circuit and the triac are each provided corresponding to the number of the power cords. The control unit 17 controls each triac connected to a power cord based on a zero-cross signal that is input from a zero-cross circuit connected to the power cord.

According to the embodiment, the soft start is explained, in which the phase angle of the triac is increased in steps. When the soft stop is performed, in which the phase angle of the triac is decreased in steps, the power supplied to each heater can be controlled in the same manner.

FIG. 5 is a schematic diagram of an example of a mechanical portion of the image forming apparatus 200 including a digital copier. The image forming apparatus 200 includes, for example, a printer function (printer mode) and a facsimile function (facsimile mode), other than a copier function (copier mode). An operator can select a function by pressing an application switch button of an operating unit (not shown).

The operation of the image forming apparatus 200 in the copier mode is explained. An operator places a plurality of documents on a document tray 202 of an automatic document feeder (ADF) 201 with a printed side up. When the operator presses a start key on the operating unit, the documents are fed one by one in order by a feed roller 203 and a feed belt 204 to a predetermined scanning position on an exposure glass 205. The ADF 201 has a counting function for counting up the number of documents every time when the document is fed to the exposure glass 205. An image on the document set on the exposure glass 205 is scanned by a scanning unit 206. Thereafter, the document is discharged onto a document discharging base 208 by the feed belt 204 and a document discharging roller 207.

Every time a scanning of an image of the document is over, a document detector 209 detects the next document on the document tray 202. If the document detector 209 detects the next document on the document tray 202, the document is fed onto the scanning position of the exposure glass 205 by the feed roller 203 and the feed belt 204, and the same operation is repeated to the document. The feed roller 203, the feed belt 204, and the document discharging roller 207 are driven by a motor (not shown).

A first feeding unit 210, a second feeding unit 211, and a third feeding unit 212 feed a plurality of sheets contained in a first sheet tray 213, a second sheet tray 214, and a third sheet tray 215, respectively. The sheet is conveyed by a vertical conveying unit 216 to the position where the sheet comes in contact with a photoreceptor 217. The photoreceptor 217 is, for example, a photoconductor drum, and is driven to rotate by a motor (not shown).

In an image processing unit (not shown), a predetermined image processing is performed to image data obtained by scanning the image on the document by the scanning unit 206. Thereafter, the image data is sent to a writing unit 218 constituting an image printing unit (printer), directly or after being once stored in an image memory (not shown). The writing unit 218 converts the image data into an optical signal. The surface of the photoreceptor 217, which is uniformly charged by a charger (not shown), is exposed by the writing unit 218 according to the optical signal to form a latent image. The latent image on the surface of the photoreceptor 217 is developed by a developing unit 219, so that a toner image is formed on the photoreceptor 217.

The printer engine is an image forming unit that includes the photoreceptor 217, the charger, the writing unit 218, the developing unit 219, a transfer unit, and the like around the photoreceptor 217, and forms an image on a sheet based on image data by the electrophotographic system. A conveying belt 220 functions as a sheet conveying unit and the transfer unit. A transfer bias is applied to the conveying belt 220 from the power supply unit. While the conveying belt 220 conveys the sheet conveyed by the vertical conveying unit 216 at the same speed as a sheet conveying speed of the photoreceptor 217, the toner image formed on the photoreceptor 217 is transferred onto the sheet at the conveying belt 220. The toner image on the sheet is fixed by the fixing unit 221, and the sheet with the toner image fixed thereon is discharged to a sheet discharging tray 223 by a sheet discharging unit 222.

The above operation is performed when an image is formed on one side of a sheet (one-side mode). For forming images on both sides of a sheet (two-side mode), first, an image is formed on one side of a sheet, which is fed from one of the first to third sheet trays 213, 214, and 215, in the same manner as above. Then, the sheet is conveyed to a conveying path 224 for reverse side image formation by the sheet discharging unit 222, instead of being discharged to the sheet discharging tray 223. The sheet is reversed by a reversing unit 225, and is conveyed to a conveying unit 226 for both-side image formation.

The sheet, which is conveyed to the conveying unit 226, is then conveyed to the vertical conveying unit 216. The vertical conveying unit 216 conveys the sheet to the position where the sheet comes in contact with the photoreceptor 217, and a toner image, which is formed on the photoreceptor 217 in the same manner as above, is transferred onto the back side of the sheet. Then, the toner image on the sheet is fixed at the fixing unit 221, whereby images are formed on both side of the sheet. The sheet with the images formed on both sides is discharged to the sheet discharging tray 223 by the sheet discharging unit 222. For discharging the sheet after reversing it, the sheet is reversed by the reversing unit 225, and is discharged to the sheet discharging tray 223 by the sheet discharging unit 222 through a reversed sheet discharging path 227, without being conveyed to the conveying unit 226.

In the printer mode, external image data is input to the writing unit 218, and an image is formed on a sheet in the same manner as above. In the case of sending image data in the facsimile mode, a facsimile sending and receiving unit (not shown) receives image data from the scanning unit 206 and sends the image data to a receiver. In the case of receiving image data in the facsimile mode, the facsimile sending and receiving unit receives image data sent from a sender, the received image data is input to the writing unit 218, and an image corresponding to the image data is formed on a sheet in the same manner as above.

The image forming apparatus 200 includes a large capacity sheet supplying tray (LCT) (not shown), a post processing unit for post processing including sorting, punching, and stapling, and an operating unit including a display unit. The display unit includes various keys and a liquid crystal display (LCD). The various keys are used for selecting a mode for scanning an image on a document, setting a magnification of a copied image, setting a sheet feeding tray, and setting a post processing at the post processing unit. The LCD displays various items thereon to provide various pieces information to an operator.

The scanning unit 206 includes the exposure glass 205, on which a document is placed, and an optical scanning system. The optical scanning system includes an exposure lamp 228, a first mirror 229, a lens 232, and a CCD image sensor 233. The exposure lamp 228 and the first mirror 229 are fixed on a first carriage (not shown), and a second mirror 230 and a third mirror 231 are fixed on a second carriage (not shown). When an image on a document is scanned, the first carriage and the second carriage are mechanically moved at a relative speed of 2:1 so that the optical path does not change. The optical scanning system is driven by a driving unit (not shown) including a scanner driving motor (not shown).

The scanning unit 206 optically scans an image on a document and converts it into an electronic signal, thereby obtaining image data of the image on the document. Specifically, a printed side of the document is exposed by the exposure lamp 228, and a reflected light image from the printed side is focused on the light receiving surface of the CCD image sensor 233 through the first mirror 229, the second mirror 230, the third mirror 231, and the lens 232 to be converted into an electronic signal. The magnification of the scanned image is changed in the document feeding direction by moving the lens 232 and the CCD image sensor 233 in right and left direction in FIG. 5. In other words, the positions of the lens 232 and the CCD image sensor 233 are determined in the right and left direction according to a preset magnification of the scanned image.

The writing unit 218 includes a laser outputting unit 234, an imaging lens 235, and a mirror 236. The laser outputting unit 234 includes therein a laser diode (LD) as a light source, and a polygon mirror that is rotated at a constant high speed by a motor. A laser beam radiated from the laser outputting unit 234 is deflected by the polygon mirror, passes the imaging lens 235, is reflected by the mirror 236, and is focused on a charged surface on the photoreceptor 217 to form a latent image on the surface.

Specifically, the laser beam deflected by the polygon mirror scans the surface of the photoreceptor 217 in the direction (main-scanning direction) perpendicular to the rotation direction of the photoreceptor 217 to write the image data, which is output from the image processing unit, on the photoreceptor 217 line by line. The main scanning is performed at a predetermined cycle corresponding to the rotation speed of the photoreceptor 217 and the scanning density (recording density) of the image, whereby a latent image is formed on the charged surface on the photoreceptor 217.

Figure 6:
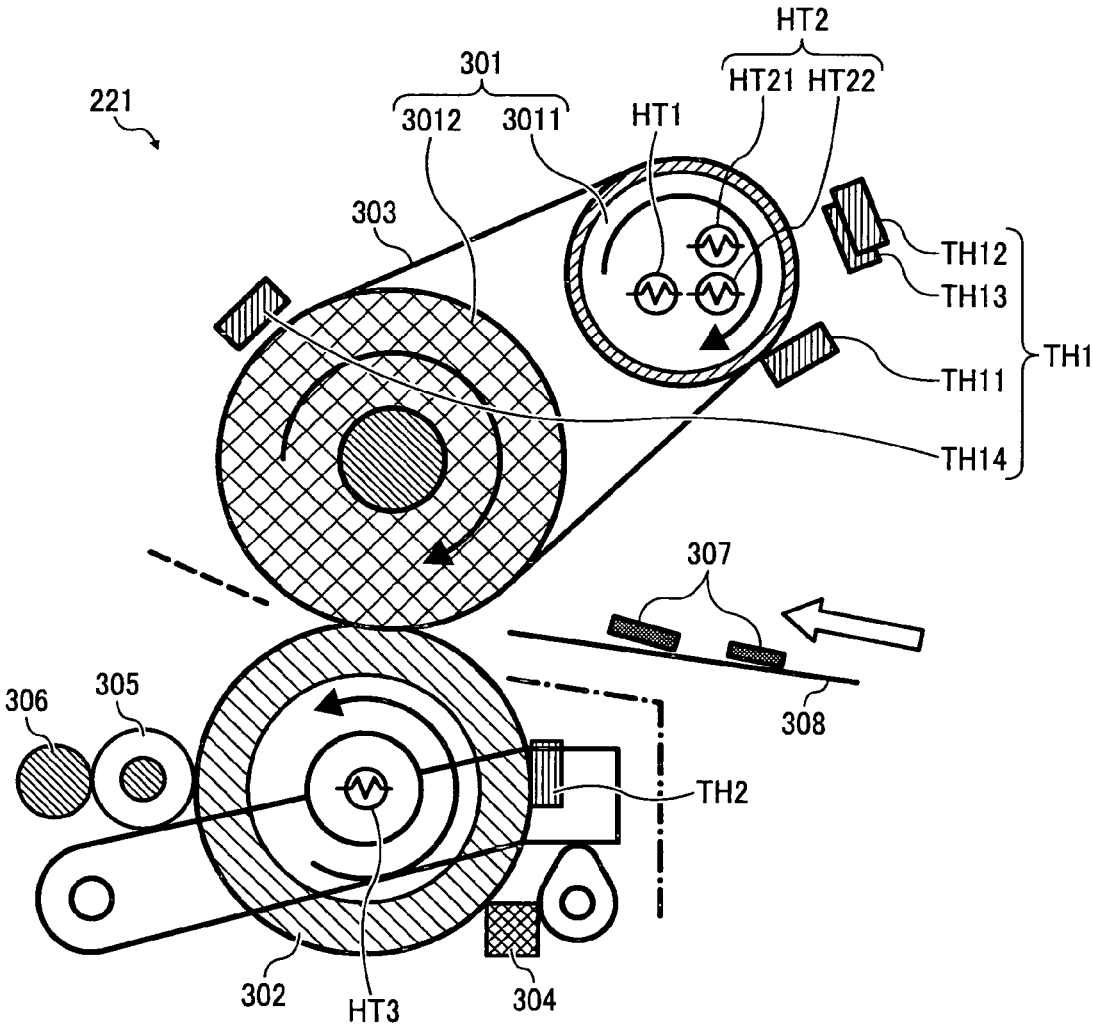
FIG. 6 is a schematic diagram of a fixing unit of the image forming apparatus shown in FIG. 5.

FIG. 6 is a schematic diagram of the fixing unit 221 shown in FIG. 5. The fixing unit 221 includes the fixing roller 301 (a heating roller 3011 and a rotating roller 3012), a pressing roller 302, and a fixing belt 303.

The heater HT1 and the heater HT2 including a heater HT21 and a heater HT22 are arranged inside the heating roller 3011. The heater HT21 heats a central portion of the heating roller 3011, and the heater HT 22 heats both end portions of the heating roller 3011. The heater HT2 functions as a major heating unit. The heater HT1 is used as an aid to heat the heating roller 3011.

The endless fixing belt 303 is stretched over the heating roller 3011 and the rotating roller 3012. The heating roller 3011 and the rotating roller 3012 are driven to rotate in arrow directions (circumferential directions) in FIG. 6 by a driving mechanism (not shown), so that the fixing belt 303 rotates in the circumferential directions of the heating roller 3011 and the rotating roller 3012. The heating roller 3011 heats a contact surface of the fixing belt 303 that is in contact with the heating roller 3011, and a recording medium 308 is heated by the heated contact surface. The fixing belt 303 rotates along the circumference of the rotating roller 3012 near the position where the fixing belt 303 is in contact with the pressing roller 302, and a nip portion is formed between the fixing belt 303 and the pressing roller 302. When the recording medium 308 passes through the nip portion, the recording medium 308 is heated by the heat transferred to the fixing belt 303 from the heating roller 3011. Therefore, the fixing belt 303 is preferably made of a material with high heat conductivity.

Arranged near the heating roller 3011 are a thermistor TH11 that detects the temperature in the center of the heating roller 3011, and noncontact NC sensors TH12 and TH13 that detect the temperatures at both sides of the heating roller 3011. In addition, a thermistor TH14, which detects the temperature of the rotating roller 3012, is arranged near the rotating roller 3012. The thermistors TH11 and TH14, and the NC sensors TH12 and TH13 correspond to the temperature sensor TH1 shown in FIG. 1. The triacs 15 and 16 can be controlled based on the temperature detected by either one of the temperature sensors, or based on the average of the temperatures detected by the temperature sensors.

The pressing roller 302 is made of an elastic member including a silicone rubber, and is pressed against the heating roller 3011 with a constant pressure by a pressing unit (not shown). The pressing roller 302 includes therein a heater HT3 that heats the pressing roller 302, and is driven to rotate in a direction indicated by an arrow in FIG. 6 by a driving mechanism (not shown). Near the pressing roller 302, a temperature sensor TH2 that detects the temperature of the pressing roller 302, and a pressure-detecting sensor 304 that detects the pressure applied to the rotating roller 3012, are provided.

FIG. 6 represents the fixing unit 221 in which the heater HT3 is arranged inside the pressing roller 302. However, the fixing unit 221 can employ other configurations, such as the one without arranging the heater HT3 and the one arranging a plurality of heaters inside the pressing roller 302. The control of the heater HT3 is not specifically described in this embodiment. However, if the driving power is supplied to the heater HT3 from an AC power supply unit other than the AC power supply units 401 and 402, the heater HT3 is controlled in the same manner as the heaters HT1 and HT2. Specifically, a zero-cross circuit is connected to the power supply line to the heater HT3, and the control unit 17 controls a triac that controls the power supplied to the heater HT3, based on a zero-cross signal that is output from the zero-cross circuit, and a thermistor signal from the temperature sensor TH2. If the power is supplied to the heater HT3 from either one of the AC power supply units 401 and 402, the control unit 17 controls the heater HT3 as a part of the heater HT1 or the heater HT2.

An oil-applying roller 305 includes a roller and an oil-impregnated pad member attached to the surface of the roller. The oil-applying roller 305 is arranged at a position such that the pad member of the oil applying roller 305 comes in contact with the surface of the pressing roller 302, thereby applying oil to the surface of the pressing roller 302. A cleaning roller 306 is arranged at the position such that the cleaning roller 306 comes in contact with the surface of the oil-applying roller 305, thereby removing adhered matter on the surface of the oil-applying roller 305.

When passing through a nip portion formed between the rotating roller 3012 (the fixing belt 303) and the pressing roller 302, the recording medium 308, such as a sheet, carrying a toner image 307 is fixed thereon by heat and pressure by the fixing roller 301 (the fixing belt 303) and the pressing roller 302.

If the temperature of the fixing roller 301 and the pressing roller 302 is lower than the target temperature Tt at the time of power-on of the image forming apparatus 200, printing, or copying, or during the transition time from a standby mode to a copy mode, the heaters HT1, HT2, and HT3 are turned on.

The image forming apparatus 200 can be employed to any image forming apparatus, such as a facsimile, a printer, and a copier.

Figure 7:
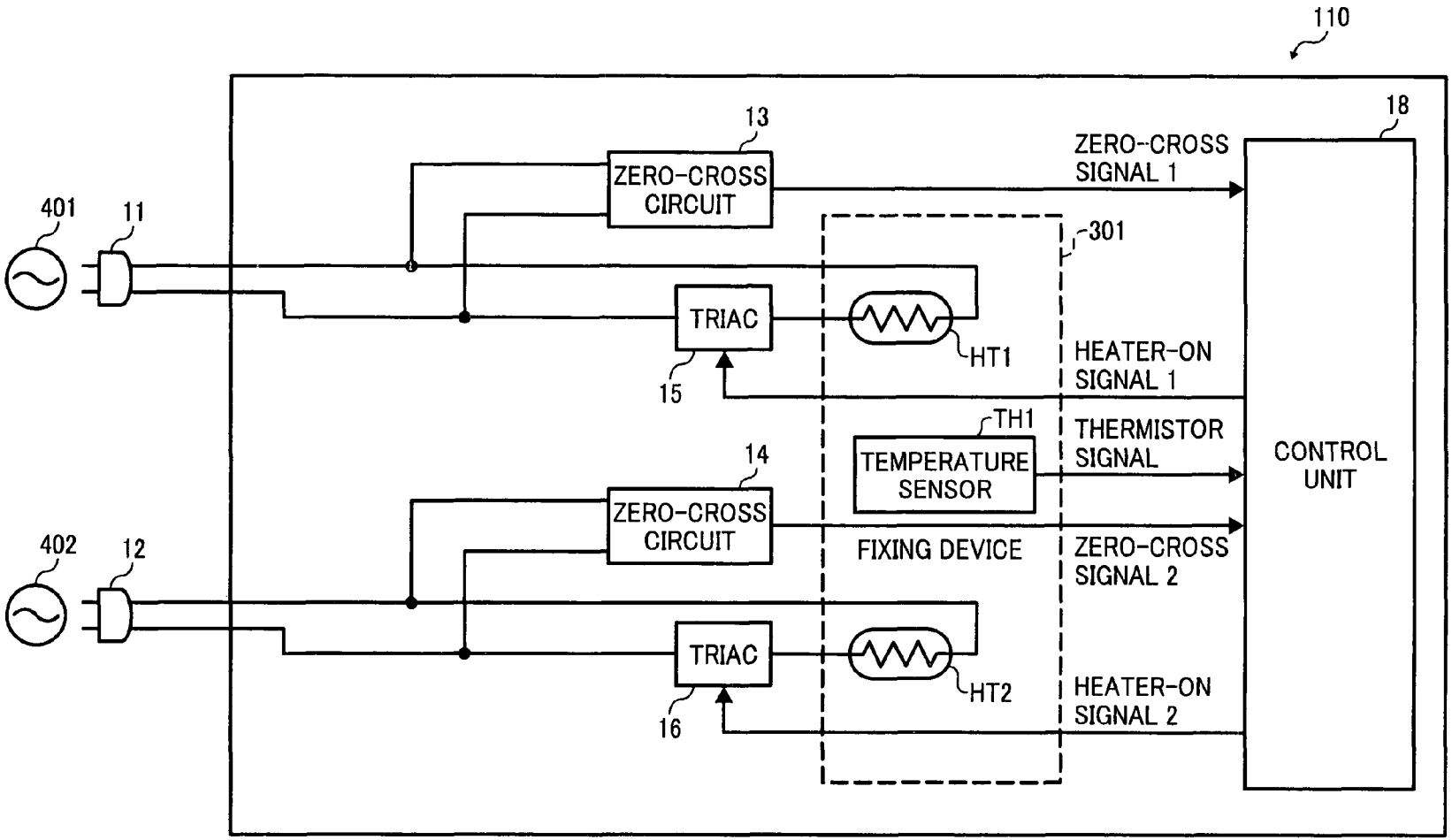
FIG. 7 is a block diagram of a heating control system according to a second embodiment of the present invention.

FIG. 7 is a block diagram of a control system 110 according to a second embodiment of the present invention. In the second embodiment, the components same as those in the first embodiment are given the same reference numerals, and the detailed explanation thereof is omitted.

A control unit 18 shown in FIG. 7, which serves as a frequency judging unit, judges frequencies of the AC power supply units 401 and 402 based on zero-cross signals that are input from the AC power supply units 401 and 402, respectively, utilizing a predetermined computer program stored in a CPU (not shown) and a ROM (not shown).

Specifically, the control unit 18 counts the number of on-states (H) of the zero-cross signal input within a predetermined time (e.g., one second), thereby judging the frequency of each AC power supply unit. For example, when 50 on-states are input in one second, the control unit 18 judges the frequency to 50 Hz, and when 60 on-states are input in one second, the control unit 18 judges the frequency to 60 Hz.

The control unit 18 corrects the output timings (phase angles) in the temperature table stored in the ROM according to the judged frequencies of the AC power supply units. Then, the control unit 18 outputs the heater-on signal 1 and the heater-on signal 2 to the triac 15 and the triac 16 with the corrected output timings, respectively.

The output timings can be corrected by a predetermined relational expression between the increase and decrease of the output timing (phase angle) and the increase and decrease of the frequency. Alternatively, an output timing, which is set for every frequency, can be previously registered in the temperature table. In this case, every time when the temperature sensor TH1 detects the temperature of the fixing roller 301, the control unit 18 reads out output timings of heater-on signals corresponding to a difference between the temperature of the fixing roller 301 and the predetermined temperature and the judged frequencies, from the ROM as corrected output timings. Then, the control unit 18 outputs the heater-on signal 1 and the heater-on signal 2 to the triac 15 and the triac 16 with the output timings, respectively.

Figure 8:
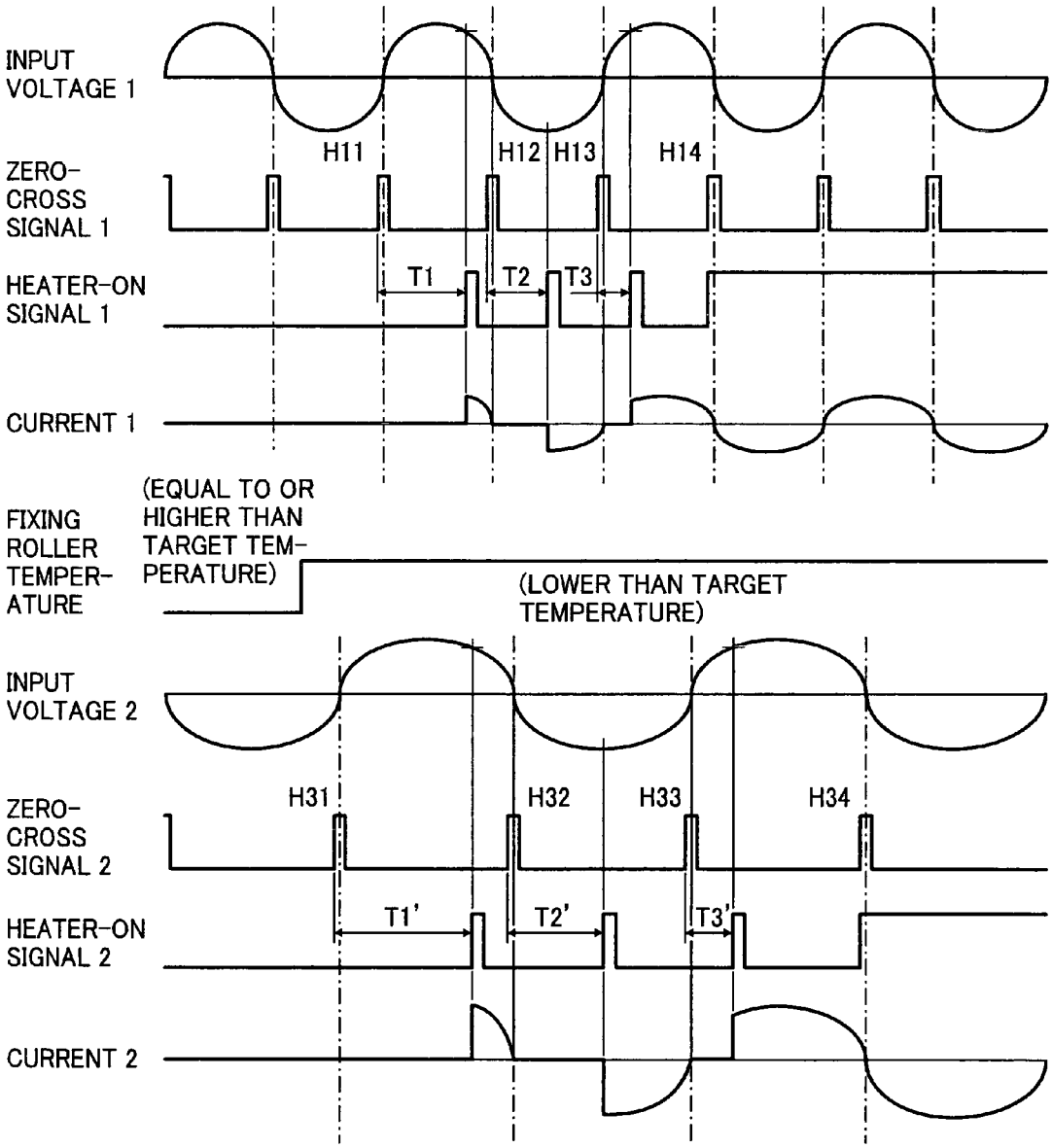
FIG. 8 is a timing chart for explaining a power control.

FIG. 8 is a timing chart for explaining a power control by the control system 110 (the control unit 18), and represents the case where the phase angle of each triac is increased in steps of 45 degrees (soft start). The specifications of the heaters HT1 and HT2 are:

For heater HT1: rated voltage AC 97 V, power consumption 250 W;

For heater HT2: rated voltage AC 97 V, power consumption 700 W.

As shown in FIG. 8, when the frequencies of the AC powers supplied from the AC power supply unit 401 and the AC power supply unit 402 are different from each other, the zero-cross timings detected by the zero-cross circuit 13 and the zero-cross circuit 14 are not in synchronized with each other. In this case, the control unit 18 judges the frequencies of the AC power supply units 401 and 402 based on the zero-cross signals that are input from the zero-cross circuits 13 and 14, respectively.

When the control unit 18 judges that the temperature of the fixing roller 301 is lower than the target temperature Tt as a result of comparison between the temperature detected by the temperature sensor TH1 and the target temperature Tt, the control unit 18 selects the phase angle of each of the heater-on signal 1 and the heater-on signal 2 that is to be output to each of the triac 15 and the triac 16. Then, the control unit 18 corrects the selected phase angles based on the frequencies of the AC power supply units 401 and 402 for the triacs 15 and 16 and outputs the heater-on signal 1 and the heater-on signal 2 to the triac 15 and the triac 16 with the corrected phase angles, respectively. Thus, the control unit 18 can control the heater HT1 and the heater HT2 individually.

When each of the frequencies of the AC power supply units 401 and the AC power supply unit 402 is the same as a predetermined frequency previously registered in the temperature table, the control unit 18 can use predetermined frequencies without correcting the phase angles.

FIG. 8 represents the case where the phase angle of the heater-on signal 1 output to the triac 15 is not corrected, and the phase angle of the heater-on signal 2 output to the triac 16 is corrected. The triac 15 is controlled in the same manner as the case shown in FIG. 4. The current amounts flowing into the heaters HT1 and HT2 are different from those in FIG. 4 due to the difference of the power consumption of each heater. The current amount flowing into each heater depends upon the power consumption of a heater.

A first pulse of the heater-on signal 2 is output to the triac 16 after a time T1' passes from the output of a zero-cross timing pulse H31. The T1' is obtained by correcting the time T1 according to the frequency of the input voltage 2. The zero-cross timing pulse H31 is the first timing pulse output after the control unit 18 detects that the temperature of the fixing roller 301 becomes lower than the target temperature Tt. Once the triac 16 becomes on-state, the triac 16 keeps the on-state until the next zero-cross timing pulse H32 at which the polarity of the input voltage 2 is reversed due to its electrical properties. Therefore, the heater HT2 is on for the time period obtained by subtracting the time T1' from a half cycle in the waveform of the input voltage 2.

When a time T2', which is obtained by correcting the T2 according to the frequency of the input voltage 2, passes from the output of the zero-cross timing pulse H32, a second pulse of the heater-on signal 2 is output to the triac 16 from the control unit 18, and the triac 16 keeps the on-state until the next zero-cross timing pulse H33. Therefore, the heater HT2 is on for the time period obtained by subtracting the time T2' from a half cycle in the waveform of the input voltage 2. When a time T3', which is obtained by correcting the time T3 according to the frequency of the input voltage 2, passes from the output of the zero-cross timing pulse H33, a third pulse of the heater-on signal 2 is output to the triac 16 from the control unit 18, and the triac 16 keeps the on-state until the next zero-cross timing pulse H34. Therefore, the heater HT2 is on for the time period obtained by subtracting the T3' from a half cycle in the waveform of the input voltage 2.

According to the second embodiment, the control unit 18 judges the frequency of each AC power supply unit, and controls the AC powers supplied from the power supply units to the triacs 15 and 16 individually. Thus, even when the frequencies of the AC powers supplied from the respective power supply units are different from each other, a harmonic current and a power voltage variation can be suppressed.

Figure 9:
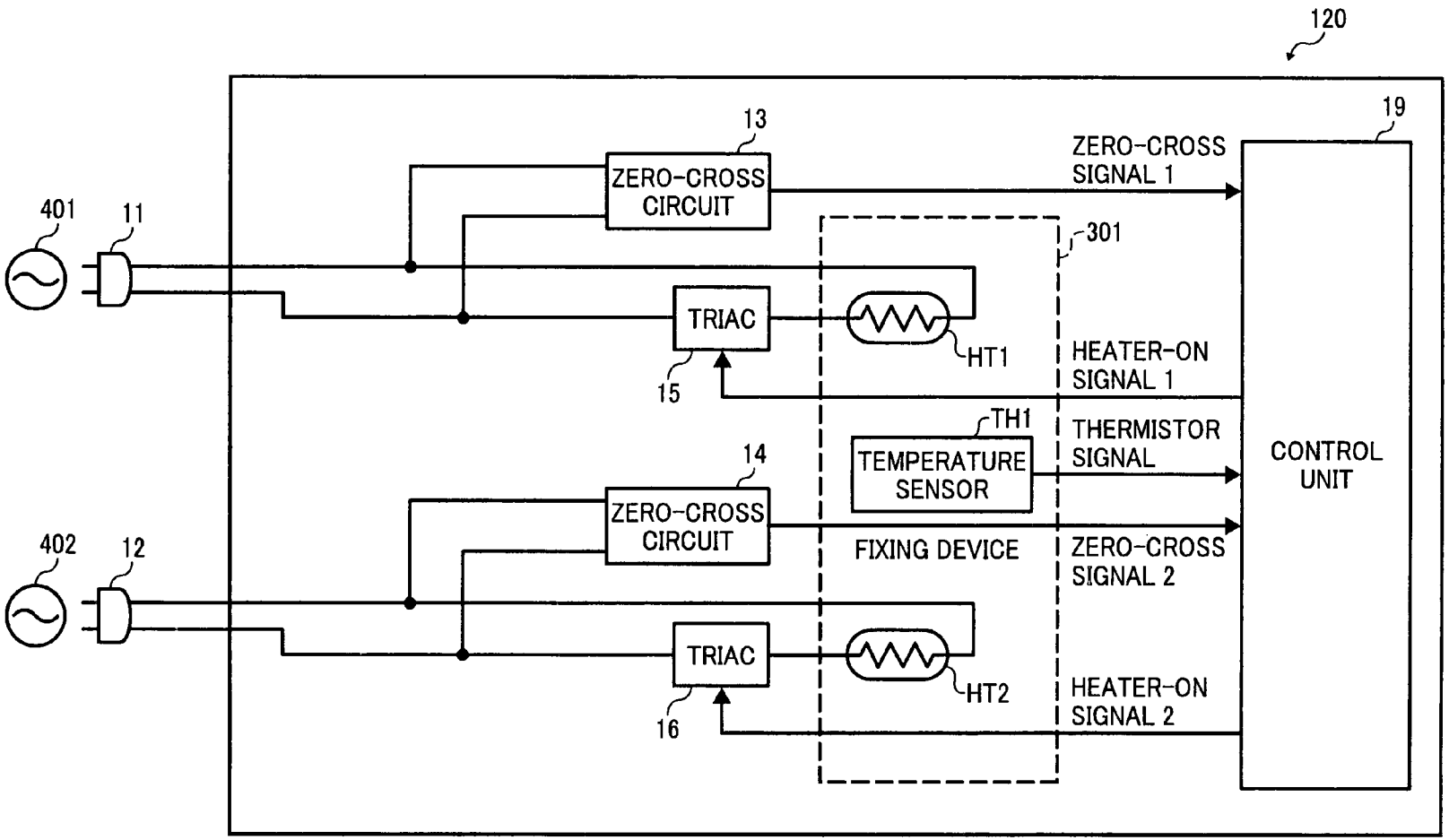
FIG. 9 is a block diagram of a heating control system according to a third embodiment of the present invention.

FIG. 9 is a block diagram of a control system 120 according to a third embodiment of the present invention. In the third embodiment, the components same as those in the first and second embodiments are given the same reference numerals, and the detailed explanation thereof is omitted.

A control unit 19 shown in FIG. 9 serves as a frequency range judging unit. The control unit 19 compares frequencies of the AC power supply units 401 and 402 with a predetermined frequency range (e.g., 45 Hz to 65 Hz) stored in a ROM (not shown), and judges whether each frequency is within the frequency range, utilizing a predetermined computer program stored in a CPU (not shown) and the ROM. Preferably, the frequency range includes the frequencies in which an image forming apparatus can operate properly, and is set depending upon a specification of each image forming apparatus.

Specifically, after judging the frequencies of the AC power supply units 401 and 402, the control unit 19 compares the frequencies with a predetermined frequency range stored in the ROM, and judges whether the frequencies are within the frequency range. A frequency that is judged by the control unit 19 not within the frequency range is extracted.

The control unit 19 controls the triacs individually so that a triac supplied with the AC power from the AC power supply unit having the frequency out of the frequency range becomes off-state. For example, when the frequency of the AC power supply unit 401 is judged to be not within the frequency range, only the triac 15, which controls the AC power supplied from the AC power supply unit 401, becomes off-state.

According to the third embodiment, a frequency that is not within a predetermined frequency range is extracted, and the AC power from the AC power supply unit having the extracted frequency is cut off. Thus, abnormal operations can be prevented in advance, enabling to improve safety.

Figure 10:
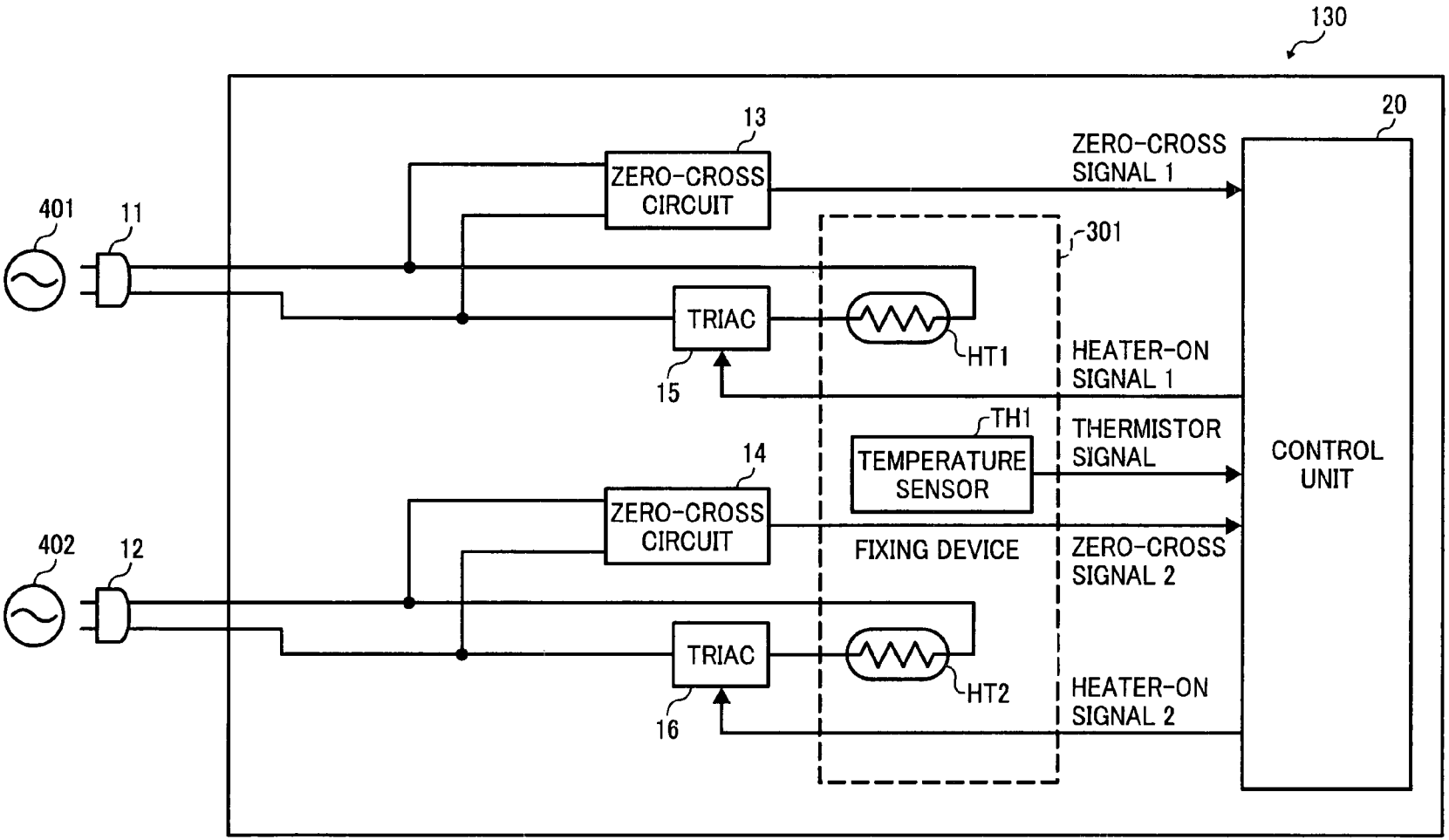
FIG. 10 is a block diagram of a heating control system according to a fourth embodiment of the present invention.

FIG. 10 is a block diagram of a control system 130 according to a fourth embodiment of the present invention. In the fourth embodiment, the components same as those in the first to third embodiments are given the same reference numerals, and the detailed explanation thereof is omitted.

A control unit 20 shown in FIG. 10 serves as a frequency range judging unit. The control unit 20 compares frequencies of the AC power supply units 401 and 402 with a predetermined frequency range stored in a ROM (not shown), and judges whether each frequency is within the frequency range, utilizing a predetermined computer program stored in a CPU (not shown) and the ROM.

When the control unit 20 judges that at least one frequency is not within the frequency range, the control unit 20 controls the triacs 15 and 16 to be off-state. For example, when the control unit 20 judges that the frequency of the AC power supply unit 401 is not within the frequency range, not only the triac 15 that controls the AC power supplied from the AC power supply unit 401, but also the triac 16 are both turned off.

According to the fourth embodiment, when a frequency that is not within a predetermined frequency range exists, the AC powers from all of the AC power supply units are cut off. Thus, abnormal operations can be prevented in advance, enabling to improve safety.

Figure 11:
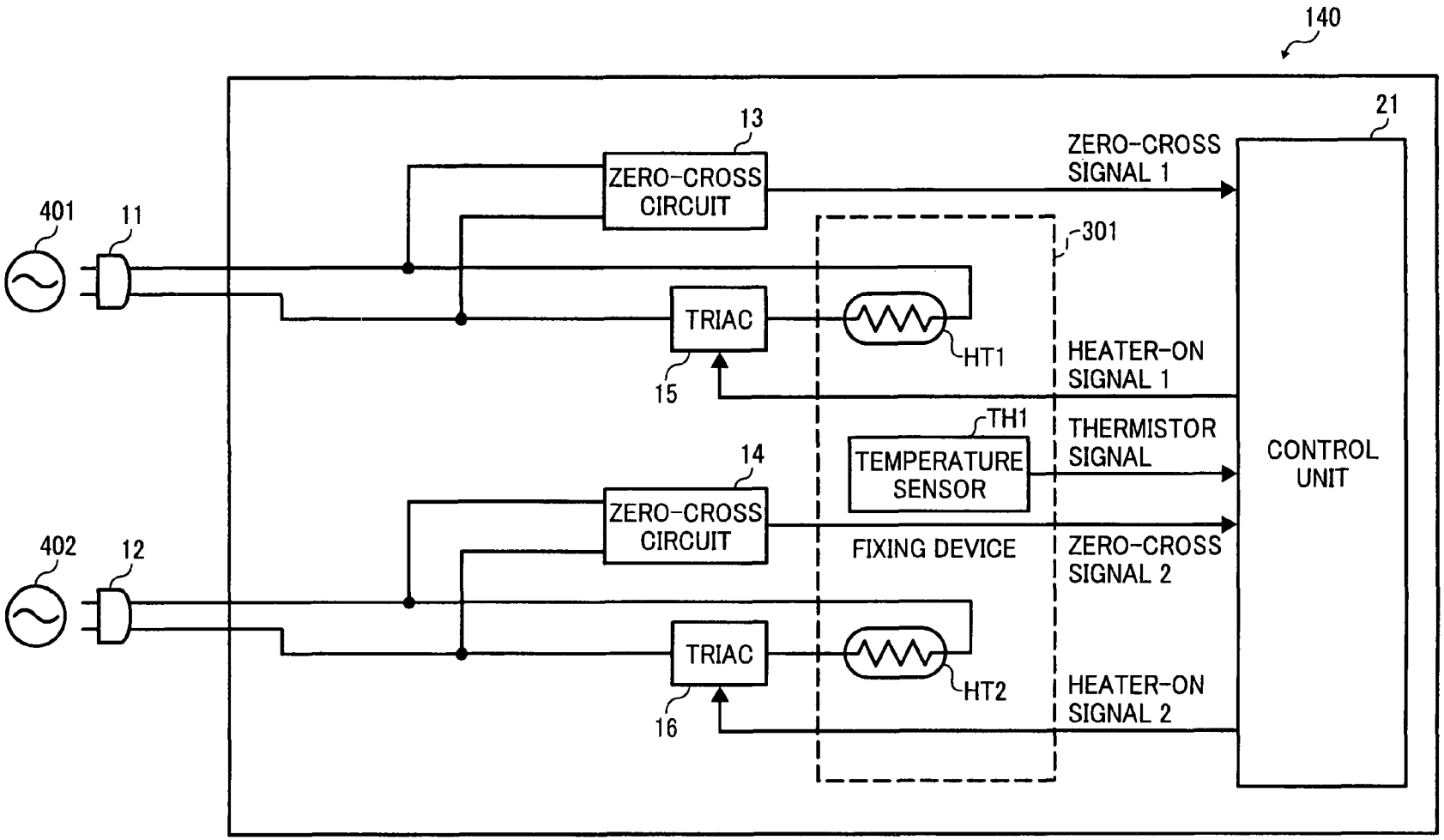
FIG. 11 is a block diagram of a heating control system according to a fifth embodiment of the present invention.

FIG. 11 is a block diagram of a control system 140 according to a fifth embodiment of the present invention. In the fifth embodiment, the components same as those in the first to fourth embodiments are given the same reference numerals, and the detailed explanation thereof is omitted.

A control unit 21 shown in FIG. 11 controls the triacs 15 and 16 based on a zero-cross signal of an AC power supply unit that supplies the AC power to a heater with the largest power consumption, utilizing a predetermined computer program stored in a CPU (not shown) and a ROM (not shown).

Specifically, based on the zero-cross timing of an AC power supply unit that supplies the AC power to the heater with the largest power consumption of zero-cross timings input from the zero-cross circuits 13 and 14, the control unit 21 judges the frequency of the AC power supply unit, and controls the triacs 15 and 16 based on the frequency and the zero-cross timing of the AC power supply unit.

For example, when the power consumption of the heater HT2 is larger than that of the heater HT1, the control unit 21 controls the triacs 15 and 16 based on the zero-cross timing and the frequency of the power supply waveform of the AC power supply unit 402 that supplies the AC power to the heater HT2.

FIG. 12 represents the power consumption (W) and the rated voltage (V) of each of the heaters HT1, HT2, and HT3, for each type of the image forming apparatus 200 in each country (Japan, USA, and Europe). 60-SPM (sheet per minute) models can print an image on 60 sheets per minute, and 75-SPM models can print an image on 75 sheets per minute. The heaters HT1, HT2, and HT3 correspond to the heaters HT1, HT2 (HT21 and HT22), and HT3 in FIG. 6.

As shown in FIG. 12, the specification of the power consumption (W) and the rated voltage (V) of each of the heaters HT1, HT2, and HT3 differs depending upon the type of the image forming apparatus 200. The 75-SPM models with higher throughput require power supply larger than that of the 60-SPM models. Because the power supplied from a commercial power supply unit is different depending upon the country in which an image forming apparatus is used, the specification of the power consumption (W) and the rated voltage (V) of each of the heaters HT1, HT2, and HT3 differs depending upon the country.

It is found in FIG. 12 that the specification of the power consumption (W) and the rated voltage (V) differs depending upon the installed position of the heater, and a target to be heated. Specifically, it is found that the power consumption (W) and the rated voltage (V) of the heater HT2, which serves as a major unit to heat the fixing roller 301 (the heating roller 3011), are larger than those of the heaters HT1 and HT3. In other words, by using the heater HT2 having the larger power consumption (W) and rated voltage (V), it is possible to shorten the time required to make the temperature of the fixing roller 301 reach the target temperature, i.e., the transition time from a standby mode to a copy mode, or the time required to be ready for copying after the power-on. Because the heaters are appropriately positioned while considering the target temperature of a member to be heated and the time required for the member to reach the target temperature (heat conductivity of the member), the specifications of the power consumption (W) and the rated voltage (V) of the heaters used in the fixing unit 221 are generally different from each other.

The control unit 21 can confirm the power consumption of each heater. For example, the power consumption of each heater can be stored in a ROM (not shown), and the control unit 21 can identify the heater having the largest power consumption by comparing the power consumptions of the heaters with each other. Alternatively, wattmeters (not shown) each measuring the power supplied to a heater can be provided in the control system 140, and the control unit 21 can identify the heater having the largest power consumption based on the power measured by each wattmeter.

Figure 13:
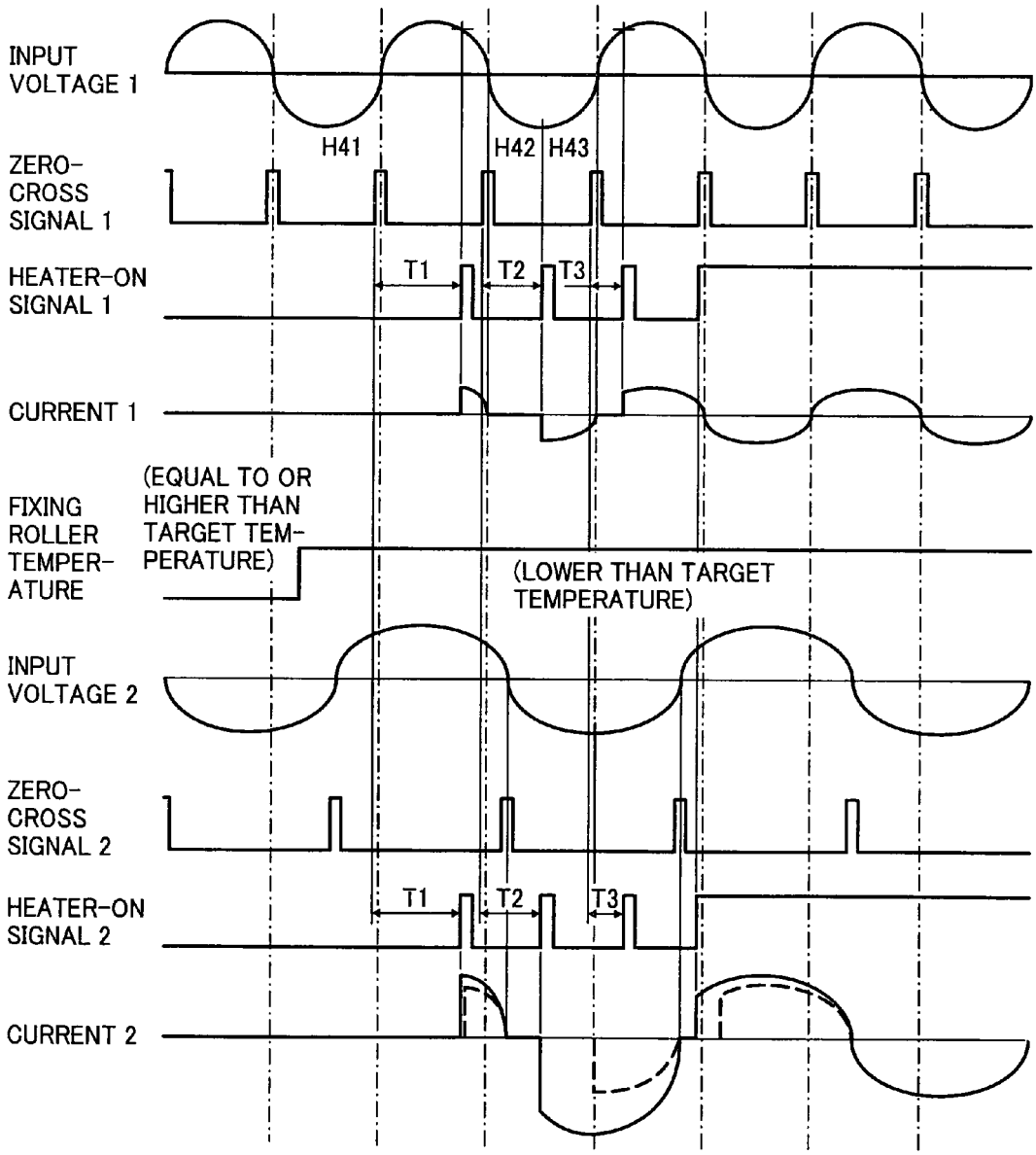
FIGS. 13 and 14 are timing charts for explaining a power control.
Figure 14:
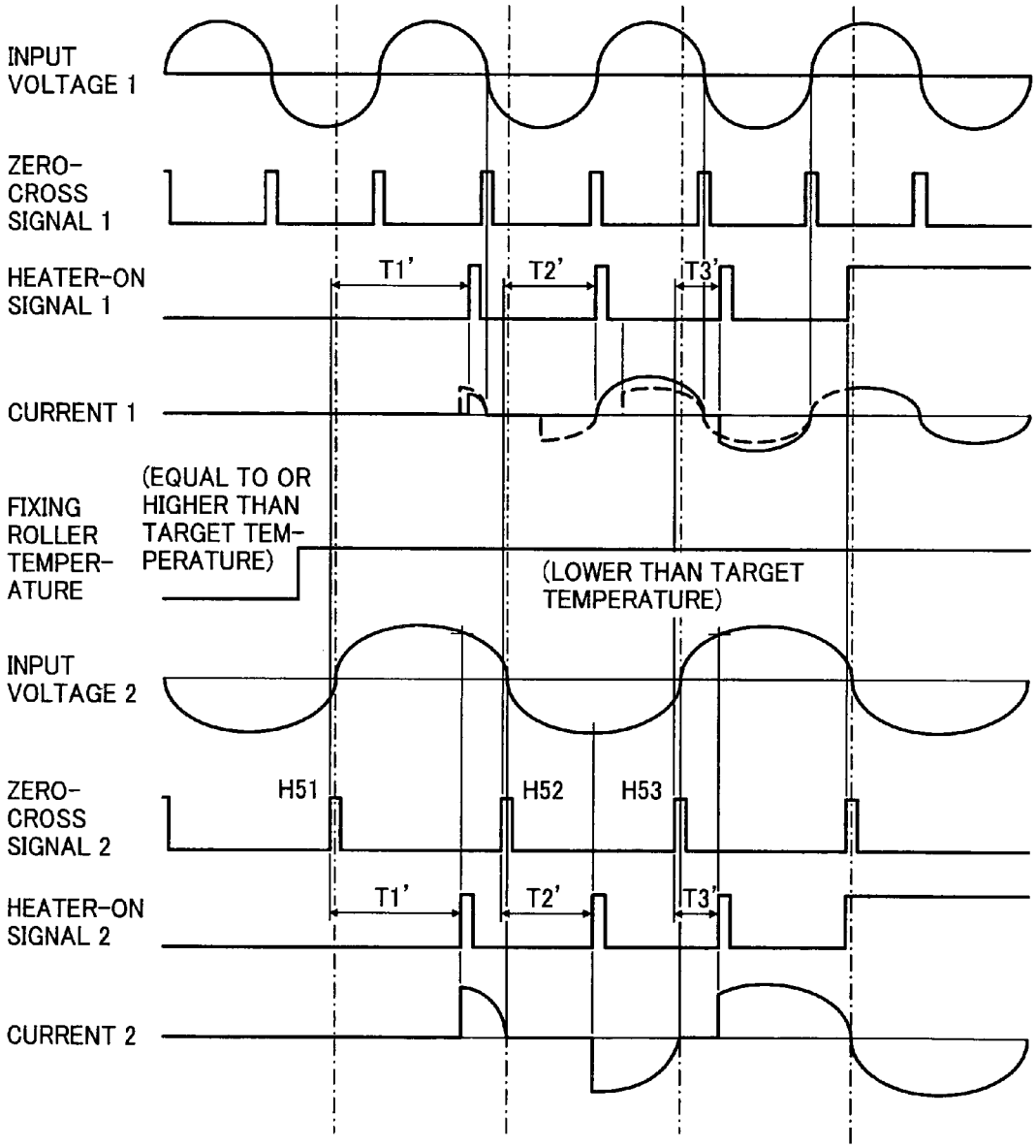

FIG. 13 is a timing chart representing the case where the triacs 15 and 16 are controlled based on a zero-cross timing and a frequency of an AC power supply unit that supplies the power to one of the heaters HT1 and HT2 having a smaller power consumption. In FIGS. 13 and 14, the phase angle of the triac 15 is increased in steps of 45 degrees (soft start). The specifications of the heaters HT1 and HT2 are:

For heater HT1: rated voltage AC 97 V, power consumption 250 W;

For heater HT2: rated voltage AC 97 V, power consumption 700 W.

As shown in FIG. 13, the phase angle of the triac 16 is controlled based on the zero-cross timing (H41 to H43) of the power supply waveform (input voltage 1) of the AC power supply unit 401 and the frequency of the AC power supply unit 401. The AC power supply unit 401 supplies the power to the heater HT1 with power consumption smaller than that of the heater HT2. In other words, the heater-on signal 2 is output to the triac 16 at the same timing as the heater-on signal 1 that is output to the triac 15.

In this case, the heater HT1 can be appropriately controlled. However, regarding the heater HT2, the heater-on signal 2 is input to the triac 16 irrespective of the phase of the input voltage 2 applied to the heater HT2. The waveform indicated by a dotted line in FIG. 13 represents the current 2 controlled to flow according to the timing of the heating-on signal 2 and the phase of the input voltage 2 applied to the heater HT2 (see "current 2" in FIG. 8).

It is found in FIG. 13 that because the power consumption of the heater HT2 is large, a large current flows even during the soft-start period. Thus, a harmonic current and a power voltage variation may occur, which may result in disadvantageously affecting other devices.

Therefore, in the control system 140 (the control unit 21) shown in FIG. 14, the triacs 15 and 16 are controlled based on the zero-cross timing and the frequency of the AC power supply unit 402 that supplies the power to the heater HT2 with the largest power consumption. Thus, occurrence of a harmonic current and a power voltage variation can be suppressed.

In FIG. 14, the control unit 21 controls the phase angles of the triacs 15 and 16 based on the zero-cross timing (H51 to H53) of the zero-cross signal 2 detected from the waveform (the input voltage 2) of the AC power supply unit 402 and the frequency of the input voltage 2 applied from the AC power supply unit 402. In other words, the control unit 21 outputs the heater-on signal 1 to the triac 15 at the same timing as the heater-on signal 2 that is output to the triac 16.

In this case, the heater HT2 can be appropriately controlled. Regarding the heater HT1, the heater-on signal 1 is input to the triac 15 irrespective of the phase of the input voltage 1 applied to the heater HT1. The waveform indicated by a dotted line in FIG. 14 represents the current 1 controlled to flow according to the timing of the heating-on signal 1 and the phase of the input voltage 1 applied to the heater HT1 (see "current 1" in FIG. 8).

However, because the power consumption of the heater HT1 is smaller than that of the heater HT2, the current that flows into the heater HT1 during the soft-start period is smaller than the current flowing in the heater HT2. Therefore, a harmonic current and a power voltage variation can be suppressed. Thus, it is possible to reduce influence on other devices.

According to the fourth embodiment, the triacs 15 and 16 are controlled based on the frequency of an AC power supply unit that supplies the power to the heater with the largest power consumption. Therefore, even when the frequencies of the powers from the power supply units are different from each other, a harmonic current and a power voltage variation can be suppressed. Thus, the operation for controlling the power supplied to each heater can be simplified.

Furthermore, the triacs 15 and 16 are controlled based on the reference phase (zero-cross points) of an AC power supply unit that supplies the power to the heater having the largest power consumption. Therefore, even when the frequencies of the powers from the power supply units are different from each other in reference phase, a harmonic current and a power voltage variation can be suppressed. Thus, the operation for controlling the power supplied to each heater can be simplified.

As described above, according to an aspect of the present invention, a harmonic current and a power voltage variation can be suppressed.

Furthermore, according to another aspect of the present invention, abnormal operations can be prevented in advance, enabling to improve safety.

Moreover, according to still another aspect of the present invention, each heating unit can be kept at a desired temperature.

Furthermore, according to still another aspect of the present invention, each power control unit can be controlled to turn on/off based on a zero-cross timing of a waveform of a AC power supply unit.

Moreover, according to still another aspect of the present invention, an image forming apparatus can be provided at low cost.

Furthermore, according to still another aspect of the present invention, a current can be applied to a heating unit according to a phase every half cycle of an AC power from an AC power supply unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a fixing unit that fixes a toner image transferred on a recording paper by heating;

a plurality of input terminals each being connected to a corresponding alternating-current power supply unit from among a plurality of alternating-current power supply units;

a plurality of heating units each generating a heat by an alternating-current power supplied from a corresponding alternating-current power supply unit through a corresponding input terminal and supplying the heat to the fixing unit;

a plurality of power control units each controlling the alternating-current power to a corresponding heating unit;

a plurality of detecting units each detecting a reference phase of waveform of the alternating-current power supplied from a corresponding alternating-current power supply unit to a corresponding heating unit through a corresponding input terminal; and a control unit that individually controls the power control units based on detected signals output from the detecting units, wherein the control unit controls the power control units based on a reference phase of an alternating-current power supply unit that supplies the alternating-current power to a heating unit having a largest power consumption from among the reference phases detected by the detecting units.

2. The image forming apparatus according to claim 1, wherein the control unit is a frequency judging unit that judges a frequency of an alternating-current power supply unit that supplies the alternating-current power to a heating unit having a largest power consumption based on the reference phase of the alternating-current power supply unit from among the reference phases detected by the detecting units, wherein the control unit controls the power control units based on the frequency of the alternating-current power supply unit judged by the frequency judging unit.

3. An image forming apparatus comprising:

a fixing unit that fixes a toner image transformed on a recording paper by heating;

a plurality of input terminals each being connected to a corresponding alternating-current power supply unit from among a plurality of alternating-current power supply units;

a plurality of heating units each generating a heat by an alternating-current power supplied from a corresponding alternating-current power supply unit through a corresponding input terminal and supplying the heat to the fixing unit;

a plurality of power control units each controlling the alternating-current power to a corresponding heating unit;

a plurality of detecting units each detecting a reference phase of waveform of the alternating-current power supplied from a corresponding alternating-current power supply unit to a corresponding heating unit through a corresponding input terminal;

a control unit that individually controls the power control units based on detected signals output from the detecting units;

wherein the control unit is configured to act as a frequency judging unit that judges frequencies of the waveforms of the alternating-current power supply units based on the reference phases of the waveforms of the alternating-current power supply units detected by the detecting units, respectively, the control unit is further configured to act as a frequency range judging unit that compares the frequencies of the waveforms of the alternating-current power supply units judged by the frequency judging units with a preset frequency range, and judges whether each of the frequencies of the waveforms of the alternating-current power supply units is within the preset frequency range, wherein the control unit controls each of the power control units separately based on a corresponding one of the frequencies of the waveforms of the alternating-current power supply units judged by the frequency fudging unit and the control unit turns off a power control unit that is judged to have a frequency out of the preset frequency range.

4. The image forming apparatus according to claim 1, further comprising:

a temperature detecting unit that detects a temperature of the fixing unit, wherein the control unit individually controls the power control units based on a difference between the temperature detected by the temperature detecting unit and a predetermined temperature.

5. The image forming apparatus according to claim 1, wherein the detecting units detect zero-cross points of the waveforms.

6. The image forming apparatus according to claim 3, wherein the control unit controls the power control units in such a manner that the alternating-current powers supplied to the heating units are increased and decreased in a stepwise manner.

7. The image forming apparatus according to claim 3, wherein the power control units are TRIACs, and the control unit controls phases of the TRIACs.

8. A method of controlling a power, comprising:

inputting an alternating-current power from each of a plurality of alternating-current power supply units to each of a plurality of input terminals;

controlling an application of the alternating-current power supplied from each of the alternating-current power supply units to each of a plurality of heating units through each of the input terminals by each of a plurality of power control units;

detecting a reference phase of waveform of the alternating-current power by each of a plurality of detecting units from the alternating-current power supplied from each of the alternating-current power supply units through each of the input terminals; and controlling the power control units individually based on detected signals output from the detecting units, wherein the controlling includes controlling the power control units based on a reference phase of an alternating-current power supply unit that supplies the alternating-current power to a heating unit having a largest power consumption from among the reference phases detected by the detecting units.

9. The method according to claim 8, further comprising:

judging a frequency of an alternating-current power supply unit that supplies the alternating-current power to a heating unit having a largest power consumption based on the reference phase of the alternating-current power supply unit from among the reference phases detected by the detecting units, wherein the controlling includes controlling the power control units based on the frequency of the alternating-current power supply unit judged at the judging.

10. The method according to claim 8, further comprising:

judging frequencies of the waveforms of the alternating-current power supply units based on the reference phases of the waveforms of the alternating-current power supply units detected by the detecting units, respectively, wherein the controlling includes controlling each of the power control units separately based on a corresponding one of the frequencies of the waveforms of the alternating-current power supply units judged at the judging.

11. The method according to claim 8, further comprising:

judging including comparing the frequencies of the waveforms of the alternating-current power supply units judged at the judging with a preset frequency range, and judging whether each of the frequencies of the waveforms of the alternating-current power supply units is within the preset frequency range, wherein the controlling includes turning off a power control unit that is judged to have a frequency out of the preset frequency range.

12. The method according to claim 8, wherein the controlling includes controlling the power control units in such a manner that the alternating-current powers supplied to the heating units are increased and decreased in a stepwise manner.

13. The method according to claim 8, further comprising:

detecting a temperature of the fixing unit, wherein the controlling includes controlling the power control units individually based on a difference between the temperature detected at the detecting a temperature and a predetermined temperature.

14. The method according to claim 8, wherein the detecting units detect zero-cross points of the waveforms.

15. The method according to claim 8, wherein the power control units are TRIACs, and the control unit controls phases of the TRIACs.

* * * * *